United States Patent [19]

Setzer

[11] Patent Number: 4,934,106

[45] Date of Patent: Jun. 19, 1990

[54] GRINDING MACHINE

[75] Inventor: Herbert Setzer, Stuttgart, Fed. Rep. of Germany

[73] Assignee: Fortuna-Werke Maschinenfabrik GmbH, Fed. Rep. of Germany

[21] Appl. No.: 243,930

[22] Filed: Sep. 13, 1988

[30] Foreign Application Priority Data

Sep. 16, 1987 [DE] Fed. Rep. of Germany ..... 3731006

[51] Int. Cl.[5] ..... B24B 5/14

[52] U.S. Cl. ..... 51/165.75; 51/105 SP

[58] Field of Search ..... 51/100 P, 105 SP, 165 R, 51/165.71, 165.75, 165.9

[56] References Cited

U.S. PATENT DOCUMENTS

| | | | |
|---|---|---|---|
| 807,323 | 12/1905 | Shimer | 51/165 R |
| 4,189,963 | 2/1980 | Sano et al. . | |
| 4,528,780 | 7/1985 | Halberschmidt et al. | 51/101 R X |
| 4,631,869 | 12/1986 | Miyatake et al. . | |
| 4,667,443 | 5/1987 | Sakurai et al. | 51/165.71 X |
| 4,709,509 | 12/1987 | Yoneda | 51/165.71 |

FOREIGN PATENT DOCUMENTS

| | | | |
|---|---|---|---|
| 3523012 | 6/1985 | Fed. Rep. of Germany . | |
| 1238954 | 6/1986 | U.S.S.R. | 51/165 R |

*Primary Examiner*—Robert P. Olszewski

*Attorney, Agent, or Firm*—Walter A. Hackler

[57] ABSTRACT

A grinding machine comprises a grinding spindle which can be displaced in a horizontal plane relative to a workpiece. The grinding spindle drives a grinding wheel, which is mounted for rotary movement about a horizontal axis, and is arranged on a swivel carriage arranged for rotary movement about a vertical axis relative to a base plate. A measuring device is provided for detecting the rotary position of the swivel carriage relative to the base plate comprise a first sensor element which is rigidly connected to the base plate and a second sensor element that can be rotated together with the swivel carriage. In order to simplify the measuring device and to make it easily accessible the sensor elements are arranged outside the said swivel carriage and the second sensor element is connected to the swivel carriage via a power transmission.

4 Claims, 4 Drawing Sheets

GRINDING MACHINE

The present invention relates to a grinding machine comprising a grinding spindle which can be displaced in a horizontal plane relative to a workpiece, the grinding spindle driving a grinding wheel, which is mounted for rotary movement about a horizontal axis, and being arranged on a swivel carriage arranged for rotary movement about a vertical axis relative to a base plate, and comprising further measuring means for detecting the rotary position of the swivel carriage relative to the base plate, which measuring means comprises a first sensor element which is rigidly connected to the base plate and a second sensor element that can be rotated together with the swivel carriage.

BACKGROUND OF THE INVENTION

A grinding machine of the type described above has been known in the art.

The known grinding machine serves for cylindrical surface grinding of rotational-symmetrical workpieces. When in the case of such workpieces an outer contour is to be ground which comprises, for example, a first cylindrical portion and a second cylindrical portion of different diameter with a conical transition zone arranged therebetween, all the three surface areas can be ground with the aid of the known grinding machine in a single operation, by changing the angular position of the grinding spindle, without the need to perform any resetting or resharpening operations first.

However, the known grinding machine is of rather complex design, as regards its swivelling mechanism, the control unit required for actuating the latter and as regards the measuring device enabling the position of the swivel carriage relative to the mounting plate to be measured. In the case of the known machine, for example, the measuring device is arranged directly in the area of the swivel carriage and, accordingly, not readily accessible with the result that on the one hand a complex structure is obtained and, on the other hand, time-consuming work is required for servicing or, if necessary, exchanging the swivel mechanism and the measuring device of the known grinding machine.

It has been found, therefore, that the measuring device of the known grinding machine does not in all cases meet today's demands regarding the required measuring precision for the rotary position of the grinding spindle.

SUMMARY OF THE INVENTION

Now, it is the object of the present invention to improve a grinding machine of the type described above in such a manner that a simple and sturdy structure of the measuring device is obtained and that the measuring device enables the rotary position of the grinding spindle to be measured with the degree of precision achievable today with the aid of rotary-angle sensors.

This object is achieved according to the invention by the fact that the sensor elements are arranged outside the swivel carriage and that the second sensor element is connected to the swivel carriage via a power transmission.

This solves the object underlying the present invention completely and perfectly as the measuring device, which is now arranged a long way outside the swivel carriage, together with the two sensor elements, are now freely accessible almost at desire, which facilitates on the one hand the electrical wiring operations and makes the unit on the other hand easily accessible for servicing and repair work if this should become necessary. The power transmission between the swivel carriage and the second sensor element may be designed with extreme mechanical precision to ensure that the second sensor element follows the rotary movement of the swivel carriage without any notable measuring error, either by synchronous angular movement or with a transmission ratio.

According to a particularly preferred variant, the power transmission causes the swivel carriage and the second sensor element to perform synchronous rotary movements.

This feature provides the advantage that any conversion operations or any linearization of non-linear characteristics is avoided and the output signal of the measuring device provides a direct measure for the angular position of the grinding spindle.

According to a further preferred embodiment of the invention, the power transmission is designed as a parallelogram linkage.

This feature provides the substantial advantage that the power transmission consists exclusively of elements capable of rotating relative to each other, with the resulting advantage that the extremely high precision of today's pivot bearings can be utilized without the need to allow, for example, for hysteresis errors of the type encountered when rotary movements have to be translated into linear movements via toothed mechanisms or the like. In addition, the parallelogram linkage offers the advantage that when the parallelogram is rotated about a given angle, the pivot bearings arranged at the corner points of the parallelogram will turn about the same angle so that in this case synchronous rotation of the second sensor elements can be achieved exclusively by making use of rotary movements.

According to a particularly preferred improvement of this variant, a first corner point of the parallelogram linkage is located on the vertical axis, while a second point adjacent the said first corner point is located at the geometrical position of the second sensor element.

This feature provides the advantage that the geometrical position of the vertical axis, i.e. the center of rotation of the grinding spindle is "reflected" upon the geometrical position of the second sensor element so that the second sensor element follows the rotary movement of the grinding spindle directly and synchronously by a corresponding rotary movement about the vertical axis.

One practical embodiment of this variant distinguishes itself by the fact that a first pivot point for a first link rod is arranged at a point of the swivel carriage spaced from the vertical axis, the free end of the said link rod being pivotally connected, at a pivot point, with a second link rod the other end of which carries the second sensor element at a second pivot point, that the length of the first link rod is equal to the length of the connection line between the second pivot point and the vertical axis, and that the length of the second link rod is equal to the length of the connection line between the first pivot point and the vertical axis.

This feature provides the advantage that the desired parallelogram linkage, with reflection of the rotary movement of the grinding spindle upon a point outside of the swivel carriage, can be implemented by the use of only two link rods with three pivot points. One obtains in this manner a particularly compact, sturdy arrangement which is suitable for use also under the rough operating conditions of machine tools and which enables the measuring device to be arranged in an easily accessible manner outside the area of movement of the swivel carriage.

Finally, another variant of this embodiment is preferred where a pivot bearing acting at the first pivot point is braced in the axial direction while a pivot bearing acting at the hinge point is movable in the axial direction.

This feature provides the advantage that the swivel carriage can be raised and lowered in the direction of the vertical axis without this movement interfering with the function of the measuring device. The raising and lowering movement of the swivel carriage may advantageously serve for lifting the swivel carriage off the base plate, on an air cushion, during its pivotal movement so that low torques will be required only for turning the swivel carriage with the units mounted thereon.

Other advantages of the present invention will become apparent from the following description and the attached drawing.

It is understood that the features that have been described above and which will be explained further below may be used not only in the described combinations, but also in other combinations or individually without leaving the scope and intent of the present invention.

BRIEF DESCRIPTION OF THE DRAWINGS

Certain embodiments of the invention will now be described in more detail with reference to the drawing in which:

Referring now to FIGS. 1 and 2, reference numeral 10 indicates generally a cylindrical surface grinding machine. A rotational-symmetrical workpiece 13 mounted between a work spindle 11 and a tailstock 12 extends along a first axis 14, usually described as z axis. In the case of non-rotational-symmetrical workpieces, the workpiece is rotated about the z axis by defined angular steps; one speaks in this case of the so-called c axis.

Figure 1A:
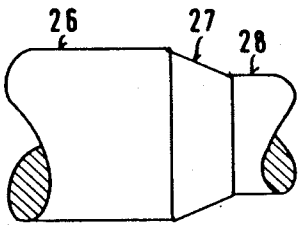
FIG. 1*a* shows a schematic elevational view of a workpiece as can be ground on the grinding machine of FIG. 1

It is understood that the grinding machine 10 has been illustrated in the drawing, and will be explained hereafter, in the form of a cylindrical surface grinder only for the sake of clarity, but that the invention is by no means limited to this particular application because the explanations given hereafter may also be related to an internal grinding machine or to grinding machines for non-rotational-symmetrical workpieces.

A base plate 19 of the grinding machine 10 carries a grinding carriage 20 which is mounted thereon for being displaced along a second axis 21, which is usually described as x axis. The second axis 21 extends to the first axis 14 at an angle $\alpha_1$, for example an angle of 55°.

The grinding carriage 20 carries a grinding spindle 22 driving a grinding wheel 23, the latter being mounted to rotate about a grinding-wheel axis 24 which usually extends at a right angle relative to the second axis 21.

Figure 1:
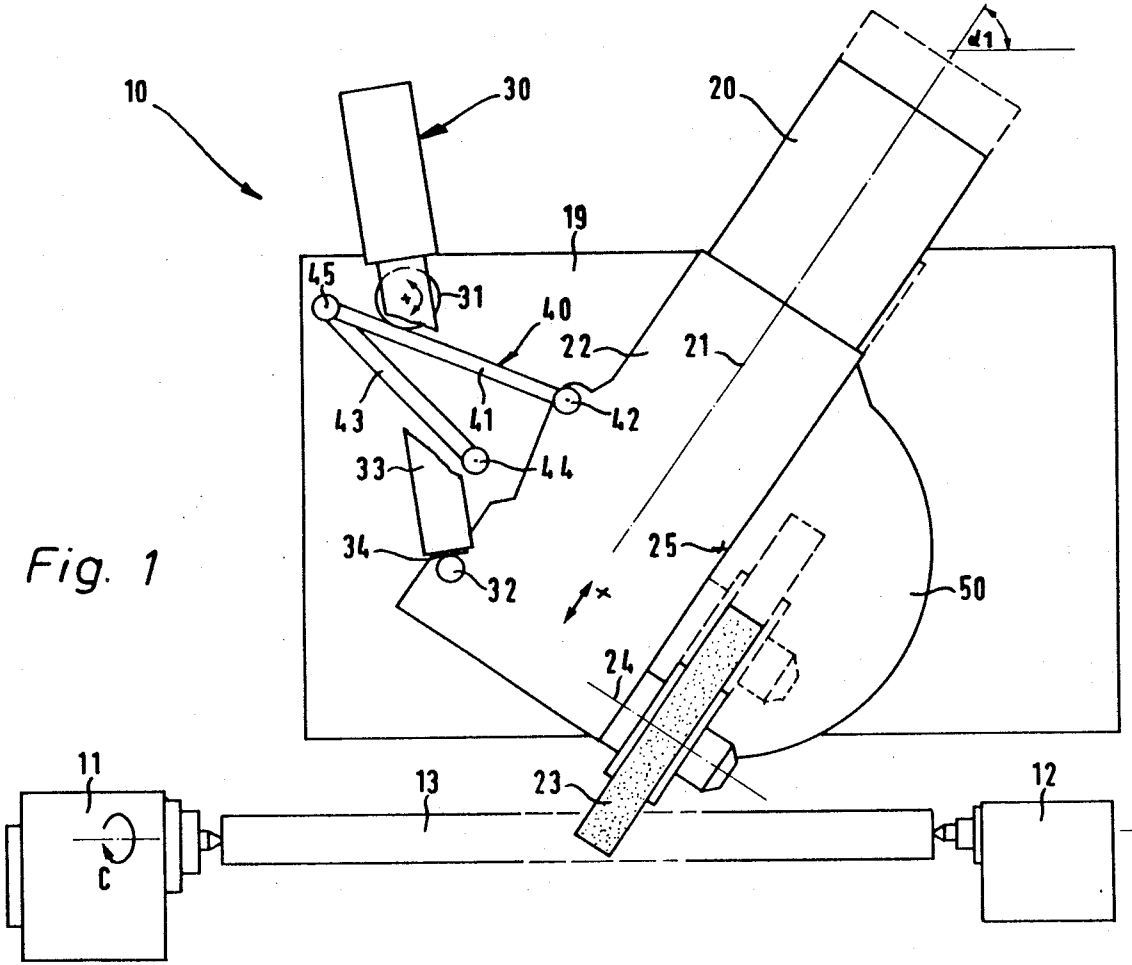
FIG. 1 shows a diagrammatic top view of one embodiment of a grinding machine according to the invention, in a first rotary end position.

The grinding spindle 22, together with the grinding carriage 20, are adapted to rotate about a third axis 25 constituting the vertical axis and extending perpendicularly to the drawing plane of FIG. 1.

This rotation of the grinding wheel 23 about the vertical axis 25 may be used, for example, for cylindrical surface grinding of the workpiece which is shown in FIG. 1*a* in enlarged scale and whose outer contour comprises a first thicker cylindrical portion 26, followed by a conical portion 27 and, finally, a second cylindrical portion 28 of smaller diameter.

For cylindrical surface grinding of such a workpiece, the grinding wheel 23 is initially pivoted into a position in which its forward grinding face extends parallel to the outer surface of the cylindrical portion 26. Upon completion of the grinding operation on the first cylindrical portion 26, the grinding spindle 22 is pivoted about the vertical axis 25 until the forward grinding face of the grinding wheel 23 extends parallel to the conical outer surface of the conical portion 27. It is not necessary for this purpose to re-mount the workpiece or to re-sharpen the grinding wheel 23. Finally, the second cylindrical portion 28 can also be ground, after re-setting of the angular position of the grinding wheel 23.

A linear drive 30 serves for pivoting the grinding carriage 20, which is mounted on a swivel carriage, together with the grinding spindle 22. The housing of the linear drive 30 is seated on the hose plate 19, by means of a first pivot mount 31, for pivotal movement about a vertical axis extending in parallel to the vertical axis 25. An operating rod 34, which can be displaced linearly in the housing of the linear drive 30, is pivoted on the swivel carriage 50, by means of a second pivot mount 32 exhibiting likewise a vertical pivot axis. One obtains in this manner a crank drive effecting the pivotal movement of the grinding carriage 20 about the vertical axis 25.

In order to determine exactly the rotary position of the grinding carriage 20 during the pivotal movement, by means of the linear drive 30, a linkage triangle 40 is provided comprising a first link 41 having its one end pivoted on the swivel carriage 50, at a first pivot point 42, while a second link 43 of the linkage triangle 40 is pivoted on the base plate 19 at a second pivot point 44. The free ends of the links 41, 43 are connected at a pivot point 45. The linkage triangle 40, defined by the corner points 42, 44 and 45, changes its configuration when the linear drive 30 is operated for pivoting the grinding carriage 20.

FIG. 1 shows a first extreme rotary position of the grinding carriage 20, where the latter has been pivoted relative to the z axis 14 by an angle $\alpha_1$ in the range of 55°. The operating rod 34 of the linear drive is fully retracted in this position, and the linkage triangle 40 occupies the first extreme position illustrated in FIG. 1.

Figure 2:
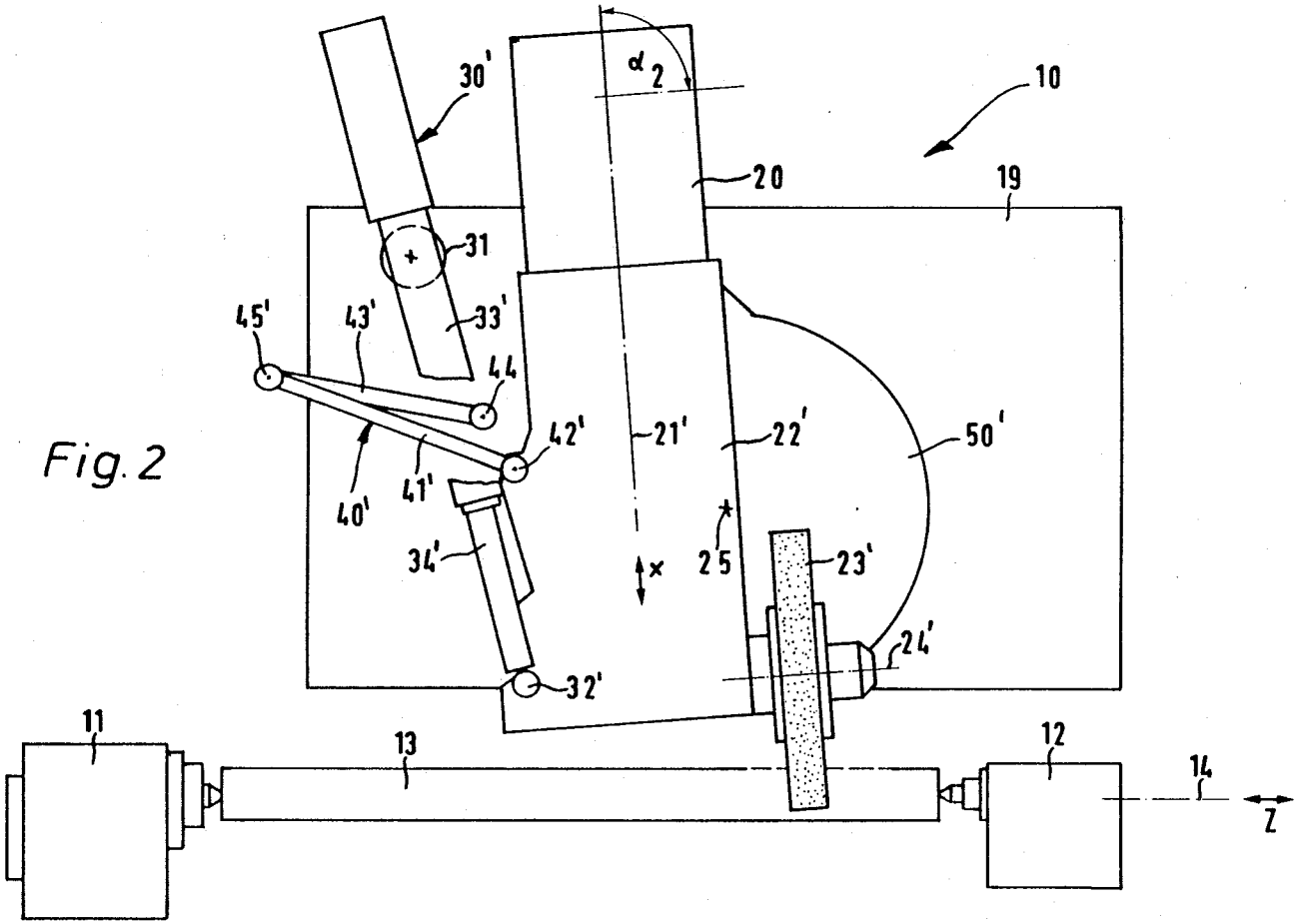
FIG. 2 shows a representation similar to that of FIG. 1, but with the machine in a second rotary end position.

Now, when the linear drive 30 is moved to the other extreme position, by extending the operating rod 34, the grinding carriage 20 is pivoted into the second extreme position illustrated in FIG. 2, in which the x axis 21 and the z axis 14 include between them an angle $\alpha_2$ of approx. 100°.

As will be seen when comparing FIGS. 1 and 2 the second pivot point 44 has been displaced during this pivotal movement, due to the corresponding displacement of the second link 43, by a defined angular amount equalling exactly the angular amount by which the grinding carriage 20 has been pivoted about the vertical axis 25, the points 25, 42, 44 and 45 coinciding with the corner points of the parallelogram. Accordingly, a rotary angle sensor is provided at the geometrical position of the pivot point 44, which rotary-angle sensor is actuated by the second link 43 relative to the base plate 19 so as to reflect in synchronism the rotary position of the grinding spindle 22.

Figure 3:
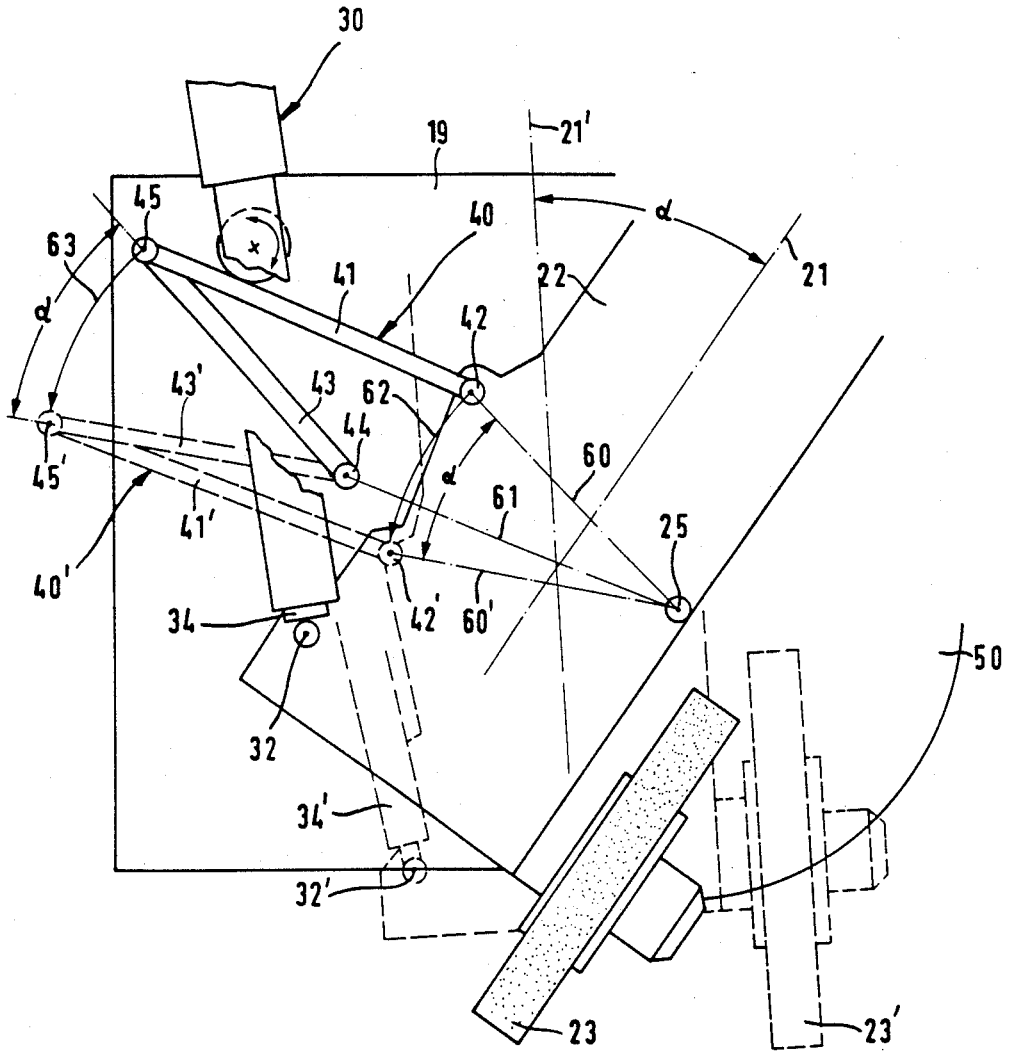
FIG. 3 shows an enlarged view of a parallelogram linkage of the type used by the grinding machine illustrated in FIGS. 1 and 2 for detecting the rotary position of the grinding spindle.

FIG. 3 shows the power transmission once more in the two positions illustrated in FIGS. 1 and 2, with the positions occupied by the individual elements in the condition of FIG. 2 marked by an apostrophy.

It appears from this illustration that the grinding spindle 22, together with the swivel carriage 50, travel between the two illustrated end positions through an angle $\alpha$, and that the x axis travels from 21 to 21'.

If the connection line from the third vertical axis 25 to the first pivot point 42 is designated by reference numeral 60, and that to the second pivot point 44 is designated by 61, then it will be readily seen that a parallelogram linkage is obtained where the length of the first link 41 is equal to the length of the connection line 61 and the length of the second link 41 is equal to the length of the connection line 60.

Now, when the swivelling carriage 50 is displaced by operation of the linear drive 30, the first pivot point 42 will be displaced in the direction indicated by arrow 62 into a position 42' and the pivot point 45 will be displaced in the direction indicated by arrow 63 into a position 45', while the points on the third vertical axis 25 and on the pivot point 44 are stationary and will not change at all.

As a result of this pivotal movement of the parallelogram linkage the second link 43 is pivoted about the same angle $\alpha$ by which the imaginary connection line 60 is pivoted to 60', and this pivot angle $\alpha$ corresponds exactly to the angle $\alpha$ by which the x axis will be pivoted from 21 to 21'.

This means that the rotary movement of the point on the third vertical axis 25 is reflected by the rotary movement of the second pivot point 44 because the rotary movement of the latter follows synchronously the rotary movement about the third vertical axis 25.

It is therefore possible to arrange measuring means for measuring the rotary movement of the grinding spindle 22 at the second pivot point 44, in which case one sensor element of the measuring means can be rigidly connected with the base plate 19, while a second sensor element is rotated by the second link 43 in synchronism with the rotation of the grinding spindle 22.

Figure 4:
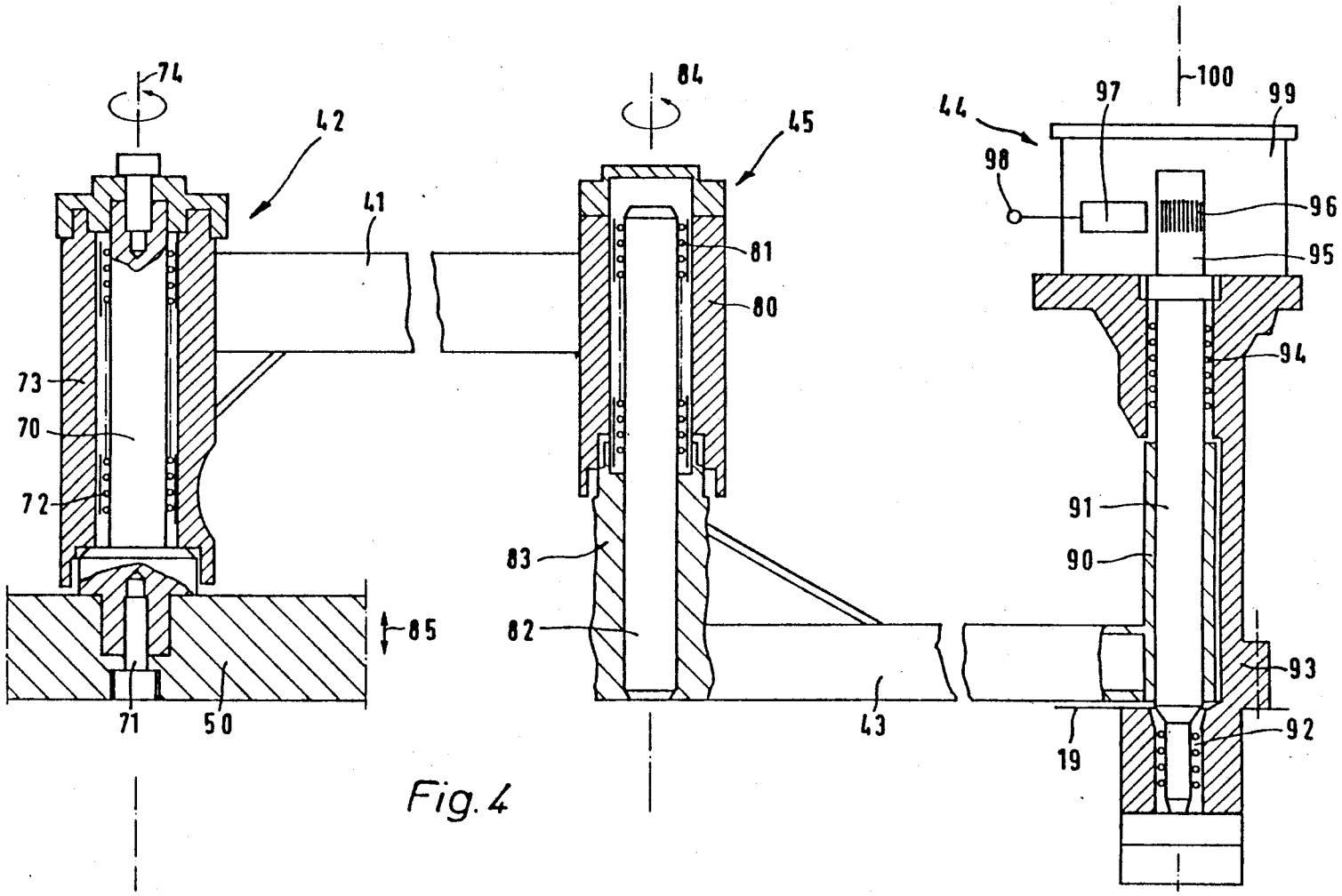
FIG. 4 shows a side view, and partial cross-section through, a linkage triangle of the type used in one practical embodiment of the invention as part of the parallelogram linkage shown in FIG. 3.

One practical embodiment of the linakge triangle 40 is represented in FIG. 4.

At the first pivot point 42 a pin 70 is screwed to the swivel carriage 50 in fixed relationship. The pin 70 engages a pivot bearing 72 which is braced in the axial direction relative to the sleeve 73. Accordingly, the link 41 fixed to the sleeve 73 is permitted to rotate in the pivot bearing 72 about an axis 74, but is fixed in the axial direction.

The first link 41 is fixed, at the pivot point 45, to a sleeve 80 which, being seated in a pivot bearing 81 not braced in the axial direction is permitted to rotate about an axis 84, relative to a pin 82, and can also move along the same axis 84. The pin 82 is fixed against rotation to another sleeve 83 which in turn is connected rigidly to the second link 43.

Due to the arrangement described before, the swivel carriage 50 is capable of performing a lifting and lowering movement in the direction of arrow 85 although the second link 83 cannot be displaced vertically. The swivel carriage 50 travels in this case together with the entire pivot point 82 and the first link 41, as well as the sleeve 80, the latter travelling axially on the pin 82 which is not braced in the axial direction by the pivot bearing 81. This arrangement, therefore, provides the possibility to balance out the lifting and lowering movement of the swivel carriage 50 which is necessary for rotating the swivel carriage 50 between two angular positions $\alpha$.

The second link 43 is connected rigidly to the sleeve 90 in which a pin 91 is seated, fixed against rotation. The pin 91 is retained against axial movment in a lower pivot bearing 92, but permitted to rotate about an axis 100. A holding part 93, which is rigidly connected with the base plate 19, accommodates the lower pivot bearing 92 and an upper pivot bearing 94 which is engaged by the upper end of the pin 91. An end 95 of the pin 91 projecting beyond the upper pivot bearing 94 is provided with markings 96. A sensor element 97 arranged near the end 95 coacts with the markings 96. A connection 98 enables measuring signals to be received from the sensor element 97. The arrangement of the sensor element 97 and of the end 95 with the markings 96 is fully enclosed by the housing 99.

It is understood that the sensor element 97 and the markings 96 have been described here only as one example of many different sensor techniques that are used in the art for rotary-angle detection, such as optical, magnetic or resistive techniques which are generally known in the field of rotary-angle technology so that they need not be described here in detail.

FIG. 4 shows very clearly that any pivotal movement of the first pivot point 42 on the swivel carriage 50 causes directly the pin 91 to perform a corresponding rotary movement at the second pivot point 44 and, thus, the markings 96 to move past the sensor element 97. Given the fact that, for the reasons outlined above in connection with FIG. 3, the pin 91 moves in synchronism with the grinding spindle 22 about the parallel axes 100 and 25, respectively, the output signal of the sensor element 97 can be taken as a direct measure of the rotary movement of the grinding spindle 22.

It is understood that numerous modifications of the above embodiments are available to the man skilled in the art without leaving the scope and intent of the present invention.

For example, instead of using a parallelogram linkage, one may also employ other polygonal linkages, crank drives or the like for translating the rotary movement of the grinding spindle into a rotary movement of a sensor. Numerous variants are possible also as regards the design and operation of the pivot bearings, and also as regards the use of specific types of sensors, as has been mentioned before. Finally, the invention may be used for all types of grinding machines, but also for any other machine tools using swivelling spindles.

I claim:

1. A grinding machine comprising a base member;

a workpiece holder mounted on said base member for holding workpieces;

a swivel carriage arranged on said base member;

a spindle mounted on said swivel carriage and comprising first drive means;

a grinding wheel being rotatably held by said spindle and being driven by said first drive means about a first axis;

second drive means for effecting relative displacement between said carriage and said workpiece to bring said grinding wheel in contact with said workpiece;

third drive means for rotating said carriage into predetermined rotary positions with respect to said base member about a second axis, perpendicular to said first axis;

measuring means for detecting said rotary positions of said carriage relative to said base plate, said measuring means comprising a first sensor element being connected to said base member and a second sensor element rotating with said carriage, said first and second sensor elements cooperating with each other during rotation of said carriage and generating an electrical signal corresponding to said rotary positions, said first and second sensor elements being, further, arranged at a predetermined first location distant from said carriage and said second sensor element being connected to said carriage via transmission means comprising a parallelogram linkage.

2. The grinding machine of claim 1, wherein a first joint of said parallelogram linkage is located on said second axis, while a second joint next to said first joint is located at said first location of said second sensor element.

3. The grinding machine of claim 2, wherein a third joint on a first end of a first link rod is arranged at a second location on said carriage distant from said second axis, a second end of said first link rod being pivotally connected, at a fourth joint, with a first end of a second link rod, a second end of which carrying said second sensor element at said second joint, said first link rod having a length being equal to a length of a connection line between said second joint and said second axis, said second link rod having a length being equal to a length of a connection line between said third joint and said second axis.

4. The grinding machine of claim 3, wherein a pivot bearing acting at said third joint is braced in an axial direction while a pivot bearing acting at said fourth joint is moveable in an axial direction.

* * * * *